US010173700B2

(12) United States Patent
Graham et al.

(10) Patent No.: US 10,173,700 B2
(45) Date of Patent: Jan. 8, 2019

(54) TOP OF RAIL APPLICATOR AND METHOD OF USING THE SAME

(71) Applicant: Whitmore Manufacturing, LLC, Rockwall, TX (US)

(72) Inventors: Dalton Lee Graham, Rockwall, TX (US); Bruce Robert Wise, Rockwall, TX (US); Kevin Ray Adkins, Rockwall, TX (US); Alejandro Medrano, Garland, TX (US); Randall Krinker, Garland, TX (US); Kelvin Chiddick, Maple Ridge, TX (US); Kyle Wilson, Garland, TX (US); David Birdwell, Garland, TX (US)

(73) Assignee: Whitmore Manufacturing, LLC, Rockwall, TX (US)

( * ) Notice: Subject to any disclaimer, the term of this patent is extended or adjusted under 35 U.S.C. 154(b) by 113 days.

(21) Appl. No.: 14/967,264

(22) Filed: Dec. 11, 2015

(65) Prior Publication Data

US 2016/0264159 A1 Sep. 15, 2016

Related U.S. Application Data

(63) Continuation-in-part of application No. 14/655,903, filed as application No. PCT/US2014/010188 on Jan. 7, 2014, now Pat. No. 9,617,498.

(Continued)

(51) Int. Cl.

*B61K 3/00* (2006.01)
*C10M 129/08* (2006.01)

(Continued)

(52) U.S. Cl.

CPC ..... *B61K 3/00* (2013.01); *C10M 105/04* (2013.01); *C10M 105/08* (2013.01);

(Continued)

(58) Field of Classification Search

CPC ..... B60B 39/00; B60B 39/021; B60B 39/025; B60B 39/08; B60B 39/083; B61K 3/00; B61K 3/02

See application file for complete search history.

(56) References Cited

U.S. PATENT DOCUMENTS 2,724,458 A 11/1955 Allard
4,115,282 A 9/1978 Grasshoff (Continued)

FOREIGN PATENT DOCUMENTS

EP 0918677 B1 6/1996
EP 1418222 A2 5/2004

(Continued)

OTHER PUBLICATIONS

European Patent Office Intl Search Report and Written Opinion, Intl Application No. PCT/US2015/065408 dated Apr. 25, 2016.

(Continued)

*Primary Examiner* — Robert J McCarry, Jr.
(74) *Attorney, Agent, or Firm* — John Wilson Jones; Jones Delflache LLP

(57) ABSTRACT

A top of rail (TOR) applicator has a bar positioned in a housing and an exit orifice on the upper portion of the bar for delivering a friction control composition to the crown of a railhead. The upper portion of the bar slopes away from the friction control composition exit orifice. The bar may be composed of an elastomer such as polyurethane. A passageway may extend from an inlet port to the exit orifice. The friction reduction composition is pumped into the inlet port, through the passageway to the exit orifice and then onto the crown of the railhead. The friction reduction composition may be thixotropic.

23 Claims, 5 Drawing Sheets

Related U.S. Application Data

(60) Provisional application No. 62/124,240, filed on Dec. 12, 2014, provisional application No. 61/963,448, filed on Dec. 4, 2013, provisional application No. 61/962,265, filed on Nov. 4, 2013, provisional application No. 61/958,789, filed on Aug. 6, 2013, provisional application No. 61/850,923, filed on Feb. 26, 2013, provisional application No. 61/850,690, filed on Feb. 21, 2013, provisional application No. 61/848,596, filed on Jan. 7, 2013.

(51) Int. Cl.

| | |
|---|---|
| ***C10M 105/04*** | (2006.01) |
| ***C10M 105/08*** | (2006.01) |
| ***C10M 173/00*** | (2006.01) |
| *C10N 30/16* | (2006.01) |
| *C10N 30/12* | (2006.01) |
| *C10N 30/02* | (2006.01) |

(52) U.S. Cl.

CPC ..... *C10M 129/08* (2013.01); *C10M 173/00* (2013.01); *C10M 2203/022* (2013.01); *C10M 2203/1025* (2013.01); *C10M 2207/00* (2013.01); *C10M 2207/022* (2013.01); *C10M 2207/0225* (2013.01); *C10M 2207/401* (2013.01); *C10N 2030/02* (2013.01); *C10N 2030/12* (2013.01); *C10N 2030/16* (2013.01); *C10N 2220/144* (2013.01); *C10N 2230/02* (2013.01); *C10N 2230/06* (2013.01); *C10N 2230/12* (2013.01); *C10N 2230/16* (2013.01)

(56) References Cited

U.S. PATENT DOCUMENTS

| | | | | |
|---|---|---|---|---|
| 4,253,976 | A | 3/1981 | Forsberg | |
| 4,915,856 | A | 4/1990 | Jamison | |
| 4,930,600 | A | 6/1990 | Kumar et al. | |
| 5,173,204 | A | 12/1992 | Chiddick et al. | |
| 5,213,697 | A | 5/1993 | Vinci et al. | |
| 5,236,063 | A | 8/1993 | Nelson et al. | |
| 5,348,120 | A | 9/1994 | Junk et al. | |
| 5,394,958 | A | 3/1995 | Junk et al. | |
| 5,477,941 | A | 12/1995 | Kumar et al. | |
| 5,554,982 | A | 9/1996 | Shirkey et al. | |
| 5,641,037 | A | 6/1997 | Wise et al. | |
| 5,714,093 | A | 2/1998 | Heimann et al. | |
| 5,896,947 | A | 4/1999 | Kumar | |
| 5,992,568 | A | 11/1999 | Craig et al. | |
| 6,135,767 | A | 10/2000 | Kesling | |
| 6,136,757 | A * | 10/2000 | Chiddick | C10M 173/02 508/126 |
| 6,328,143 | B1 | 12/2001 | Shute et al. | |
| 6,434,452 | B1 | 8/2002 | Gray | |
| 6,578,669 | B2 | 6/2003 | Kast et al. | |
| 6,612,245 | B2 | 9/2003 | Kumar et al. | |
| 6,719,095 | B2 | 4/2004 | Arens et al. | |
| 6,742,624 | B2 | 6/2004 | DiCarlo | |
| 6,759,372 | B2 | 7/2004 | Cotter | |
| 6,854,908 | B2 | 2/2005 | Hui et al. | |
| 6,855,673 | B2 | 2/2005 | Cotter et al. | |
| 6,971,479 | B1 | 12/2005 | Urmson, Jr. et al. | |
| 7,045,489 | B2 | 5/2006 | Cotter et al. | |
| 7,160,378 | B2 | 1/2007 | Eadie et al. | |
| 7,244,695 | B2 | 7/2007 | Eadie | |
| 7,258,201 | B2 | 8/2007 | Urmson, Jr. et al. | |
| 7,273,131 | B2 | 9/2007 | Urmson, Jr. et al. | |
| 7,557,748 | B1 | 7/2009 | Zahm et al. | |
| 7,939,476 | B2 | 5/2011 | Eadie et al. | |
| RE42,989 | E | 12/2011 | Eadie et al. | |
| 8,074,772 | B2 | 12/2011 | Urmson, Jr. et al. | |
| 8,305,567 | B2 | 11/2012 | Hesser et al. | |
| 8,473,128 | B2 | 6/2013 | Oldknow et al. | |
| 8,492,474 | B2 | 7/2013 | Gallucci et al. | |
| 8,584,804 | B2 | 11/2013 | Holland | |
| 8,955,645 | B2 | 2/2015 | Singleton et al. | |
| 9,016,436 | B2 | 4/2015 | Paluncic et al. | |
| 9,022,173 | B2 | 5/2015 | Singleton et al. | |
| 9,617,498 | B2 | 4/2017 | Chiddick et al. | |
| 2002/0157901 | A1 | 10/2002 | Kast et al. | |
| 2003/0111295 | A1 | 6/2003 | Kumar et al. | |
| 2004/0038831 | A1 | 2/2004 | Eadie | |
| 2007/0272486 | A1 | 11/2007 | Eadie et al. | |
| 2008/0223661 | A1 | 9/2008 | Singleton et al. | |
| 2009/0000869 | A1 * | 1/2009 | Holland | B61K 3/00 184/3.1 |
| 2010/0105583 | A1 | 4/2010 | Garmier | |
| 2010/0300810 | A1 | 12/2010 | Singleton et al. | |
| 2011/0059876 | A1 | 3/2011 | Takahama et al. | |
| 2011/0190177 | A1 | 8/2011 | Zaki | |
| 2013/0331589 | A1 | 12/2013 | Raczkowski et al. | |
| 2013/0341126 | A1 | 12/2013 | Singleton et al. | |
| 2014/0029028 | A1 | 2/2014 | Fallon et al. | |
| 2014/0054113 | A1 | 2/2014 | Powell et al. | |
| 2014/0060972 | A1 | 3/2014 | Appleby et al. | |

FOREIGN PATENT DOCUMENTS

| | | | |
|---|---|---|---|
| GB | 2446949 | A | 8/2008 |
| GB | 2446949 | B | 8/2008 |
| JP | 2002145062 | A | 5/2002 |
| JP | 2003-276604 | A | 10/2003 |
| JP | 2010-59274 | A | 3/2010 |
| WO | 01/18558 | A1 | 3/2001 |
| WO | 02/26918 | A1 | 4/2002 |
| WO | 03/064233 | A1 | 8/2003 |
| WO | 03/095283 | A2 | 11/2003 |
| WO | 2004-096960 | A1 | 11/2004 |
| WO | 2010138819 | A2 | 12/2010 |
| WO | 2014/029028 | A1 | 2/2014 |

OTHER PUBLICATIONS

Tanaka et al., "The estimation method of wheel load and lateral force using the axlebox acceleration", Railway Technical Research Institute, Tokyo, Japan, pp. 1-10 (2009).

* cited by examiner

TOP OF RAIL APPLICATOR AND METHOD OF USING THE SAME

This application claims the benefit of U.S. patent application Ser. No. 62/124,240 filed on Dec. 12, 2014 and further is a continuation-in-part application of U.S. patent application Ser. No. 14/655,903, filed on Jun. 26, 2015, a national stage entry of PCT/US14/10188 which in turn claims the benefit of U.S. Patent Application Ser. No. 61/963,448, filed on Dec. 4, 2013; U.S. Patent Application Ser. No. 61/962,265 filed on Nov. 4, 2013; U.S. Patent Application Ser. No. 61/958,789, filed on Aug. 6, 2013; U.S. Patent Application Ser. No. 61/850,923 filed on Feb. 26, 2013; U.S. Patent Application Ser. No. 61/850,690, filed on Feb. 21, 2013; and U.S. Patent Application Ser. No. 61/848,596, filed on Jan. 7, 2013, all of which are herein incorporated by reference.

FIELD OF THE DISCLOSURE

The disclosure relates to an applicator for delivery of a friction control composition to a railhead and a method of using the same to control friction between the railhead and train wheels.

BACKGROUND OF THE DISCLOSURE

The emission of high noise levels and extensive wear of steel wheels and steel rails is a common problem in rail systems, including freight, passenger and mass transit trains. Such problems are directly attributed to the frictional forces generated between the wheel and the railhead during operation of the system. In addition to noise problems and extensive wear of the wheels and rails, negative friction between the two sliding steel surfaces cause slip-stick oscillations. This, in turn, results in inefficient as well as sub-optimum performance.

In order to control friction, it has long been the practice to apply grease or friction control compositions onto the rail, including onto the railhead as well as the sides of the rail. Most notably, such compositions have been applied at curves, inclines, turnouts, switches, etc. Friction control compositions can either reduce or increase the friction when necessary to improve train performance and reduce wear on both the railhead and the train wheels.

In order to increase friction between the train wheel and the rail, the friction control composition is typically placed on the railhead. Applicators used to place friction control compositions onto railheads are called top of rail (TOR) applicators. In normal practice, TOR applicators are periodically spaced along the length of the rail track. The spacing of TOR applicators is typically dependent on the ability of the friction control composition to carried down the rail. Unfortunately, when compared to applicators placed on the side of the rail, TOR applicators, in direct contact with the train wheel, are more likely to be damaged or destroyed by train wheels.

TOR applicators have been developed over the years to address this issue. However, such applicators have proved to be inadequate for a number of reasons. For example, in some prior art applicators, the friction control composition typically does not reach the center of the railhead. As a result, the friction control composition is not effectively carried down the rail. In other cases, substantial amounts of the friction control composition are wasted because the friction control composition ends up leaking down the sides of the rail and off the railhead. In other instances, while prior art TOR applicators place the friction control composition on the railhead, the applicator itself is damaged or destroyed by impact when hit by train wheels. Thus, such TOR applicators of the prior art become inoperable from impact damage.

TOR applicators that effectively place the friction control composition onto the railhead such that the friction control composition is efficiently carried down the track are desired. In addition, such TOR applicators need to be relatively safe from being damaged or destroyed from the impact of train wheels.

It should be understood that the above-described discussion is provided for illustrative purposes only and is not intended to limit the scope or subject matter of the appended claims or those of any related patent application or patent. Thus, none of the appended claims or claims of any related application or patent should be limited by the above discussion or construed to address, include or exclude each or any of the above-cited features or disadvantages merely because of the mention thereof herein.

SUMMARY OF THE DISCLOSURE

In an embodiment of the disclosure, an applicator is provided for delivering a friction control composition to a railhead. The applicator is composed of a housing, a bar positioned in the housing and an exit orifice on the upper portion of the bar for delivering the friction control composition to the crown of the railhead.

In another embodiment of the disclosure, an applicator is provided for delivering a friction control composition to a railhead. The applicator is composed of a housing, an elastomeric bar positioned in the housing, an entry port for pumping the friction control composition into a passageway, and an exit port for pumping the friction control composition onto the railhead.

In another embodiment of the disclosure, an applicator is provided for delivering a friction control composition to a railhead. The applicator is composed of a housing, a bar positioned in the housing, an entry port located on the lower portion of the slope for feeding the friction control composition into a passageway and an exit orifice on the upper portion of the bar for delivering the friction control composition to the crown of the railhead from the passageway. The upper portion of the bar slopes away from the friction control composition exit orifice. In an embodiment, the upper portion of the bar slopes away from the friction control composition exit at an angle between from about 5 to about 15 degrees. The applicator assembly may also contain a platform for the bottom surface of the housing, a clamp for coupling the applicator onto the railhead via the platform and a leveler.

In another embodiment of the disclosure, an applicator assembly is provided for delivering a friction control composition to a railhead. The applicator assembly comprises an applicator composed of a housing, a bar positioned in the housing and an exit orifice on the upper portion of the bar for delivering the friction control composition to the crown of the railhead. The applicator assembly may also contain a platform for the bottom surface of the housing, a clamp for coupling the applicator onto the railhead via the platform and a leveler.

In another embodiment of the disclosure, an applicator assembly is provided for delivering a friction control composition to a railhead; the applicator assembly comprising a housing, an elastomeric bar positioned in the housing, an entry port for pumping the friction control composition into a passageway and an exit port for pumping the friction control composition onto the railhead. The applicator assembly further contains a platform onto which the bottom surface of the housing is seated, a leveler attached to the platform and a clamp coupled to the platform for affixing the applicator assembly onto the railhead.

In another embodiment of the disclosure, an applicator assembly is provided for delivering a friction control composition to a railhead. The applicator assembly comprises an applicator composed of a housing, a bar positioned in the housing, an entry port located on the lower portion of the slope for feeding the friction control composition into a passageway and an exit orifice on the upper portion of the bar for delivering the friction control composition to the crown of the railhead from the passageway. The applicator assembly may also contain a platform for the bottom surface of the housing, a clamp for coupling the applicator onto the railhead via the platform and a leveler.

In another embodiment, a method of delivering a friction control composition onto the crown of a railhead using an applicator assembly is provided. The applicator assembly is composed of an applicator and a clamp. The applicator is composed of a housing, a bar positioned in the housing and a friction control composition exit orifice on the upper portion of the bar. The upper portion of the bar slopes away from the friction control composition exit orifice. In an embodiment, the upper portion of the bar slopes away from the friction control composition exit at an angle between from about 5 to about 15 degrees. The clamp couples the platform onto a railhead of a rail. In the method, the friction control composition is pumped through the exit orifice onto the crown of the railhead.

In another embodiment of the disclosure, a method of delivering a friction control composition onto the crown of a railhead using an applicator assembly is provided. The applicator assembly is composed of an applicator and a clamp. The applicator is composed of a housing, a bar positioned in the housing and a friction control composition exit orifice on the upper portion of the bar. The bar of the applicator has an entry port for the friction control composition. In addition, the applicator has a passageway from the friction control composition entry port to the friction control composition exit orifice for transporting the friction control composition. The upper portion of the bar slopes away from the friction control composition exit orifice. In an embodiment, the upper portion of the bar slopes away from the friction control composition exit at an angle between from about 5 to about 15 degrees. The clamp couples the platform onto a railhead of a rail. In the method, the friction control composition is pumped through the exit orifice onto the crown of the railhead. In the method, the friction control composition is pumped through the exit orifice onto the crown of the railhead.

Accordingly, the present disclosure includes features and advantages which are believed to enable it to most effectively place friction control compositions onto rails.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF THE PREFERRED EMBODIMENTS

Figure 1:
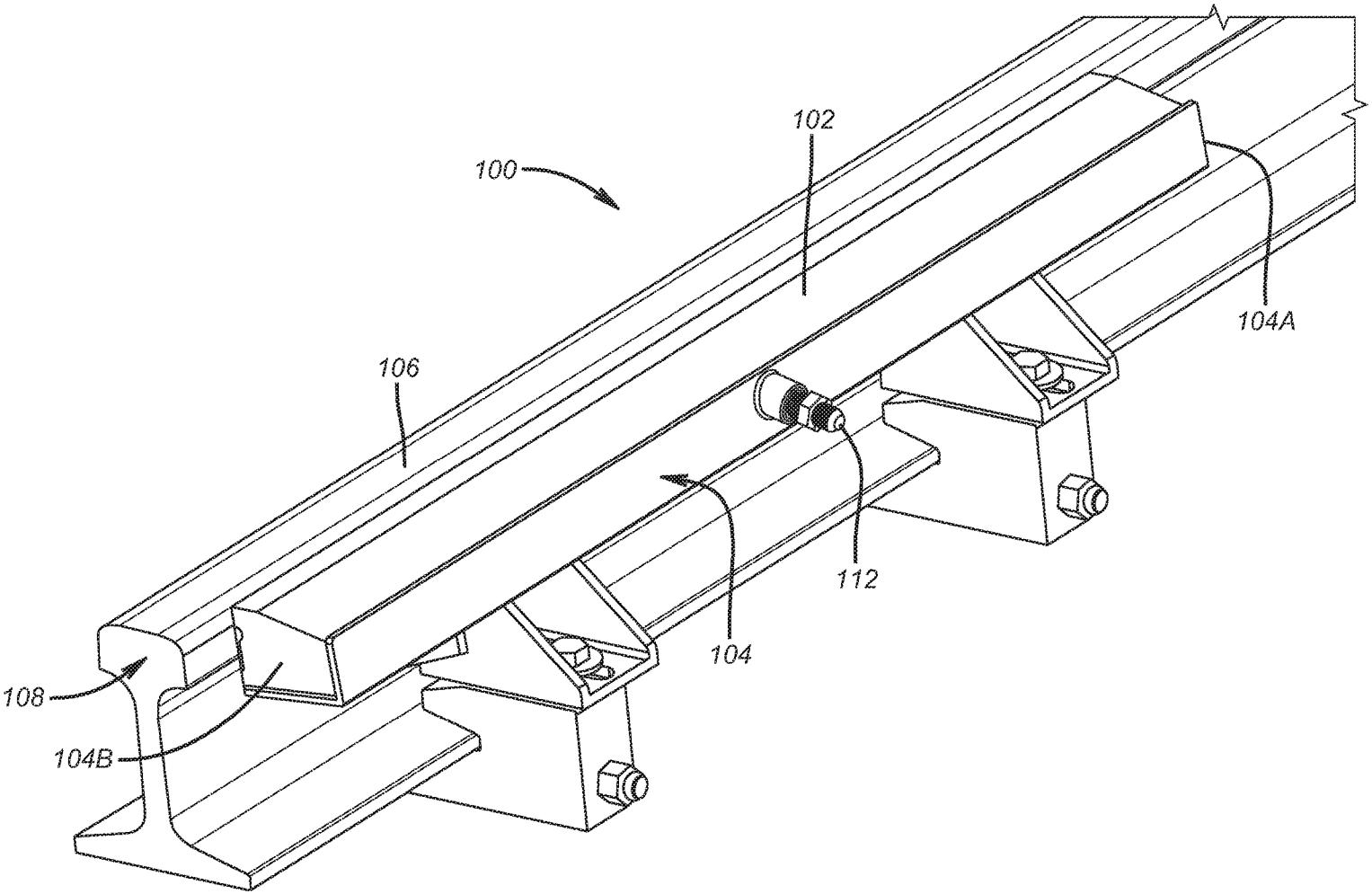
FIG. 1 is a front perspective view of a top of rail (TOR) applicator assembly affixed to the side of a rail.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "disclosure", "present disclosure" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference.

The term "coupled" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function.

Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Preferred embodiments of the present disclosure thus offer advantages over the prior art and are well adapted to carry out one or more of the objects of this disclosure. However, the present disclosure does not require each of the components and acts described above and are in no way limited to the above-described embodiments or methods of operation. Any one or more of the above components, features and processes may be employed in any suitable configuration without inclusion of other such components, features and processes. Moreover, the present disclosure includes additional features, capabilities, functions, methods, uses and applications that have not been specifically addressed herein but are, or will become, apparent from the description herein, the appended drawings and claims.

The top of rail applicator (TOR) disclosed herein may be used to deliver a friction control composition (or a lubricant) to a railhead, most notably the crown of the railhead. The TOR applicator, when affixed to a railhead, is less likely to be damaged by a train wheel. As such, the friction control composition is more efficiently carried down the top of the railhead.

Figure 2:
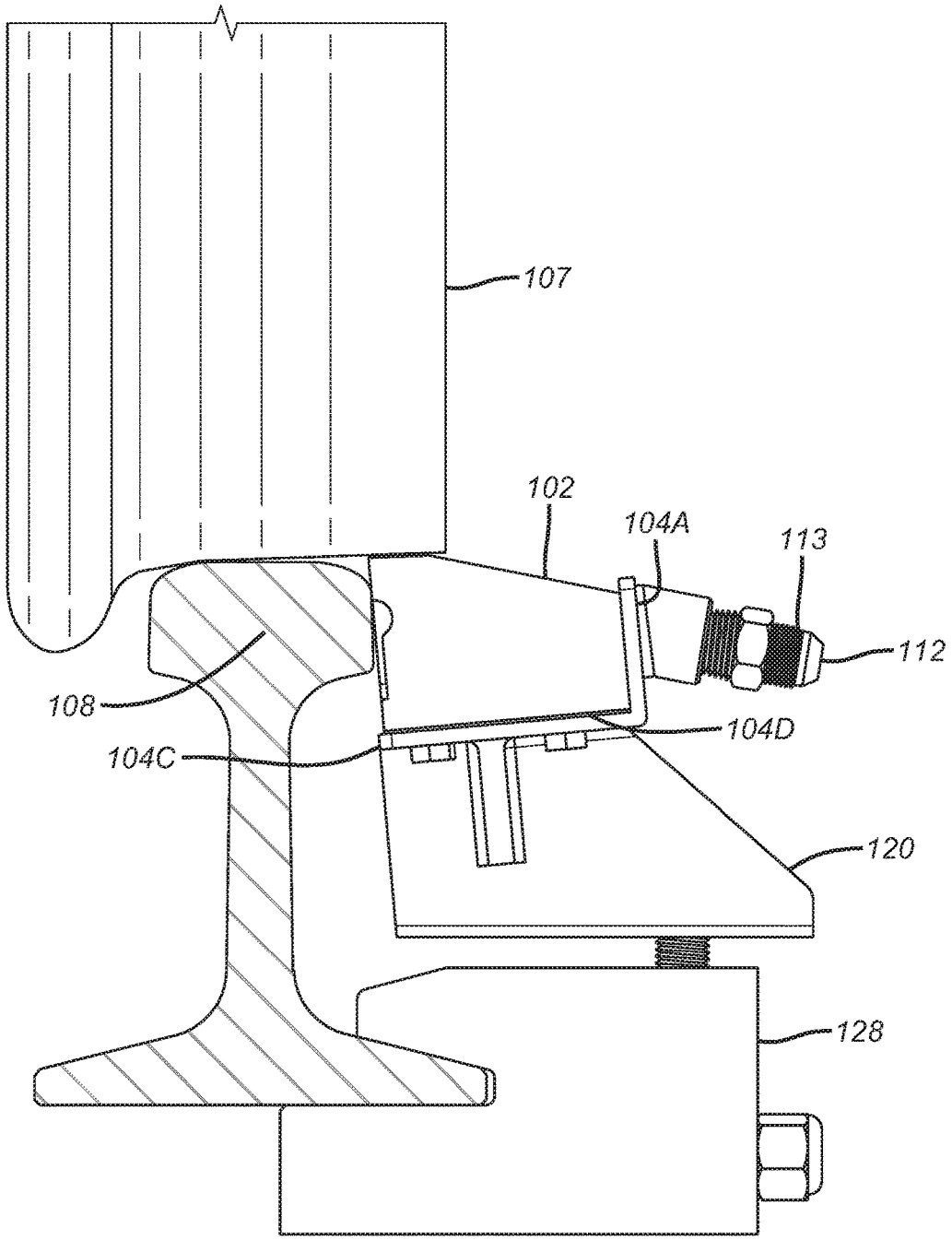
FIG. 2 is a side view of a TOR applicator assembly and illustrates the interaction of the TOR applicator and a train wheel.
Figure 3:
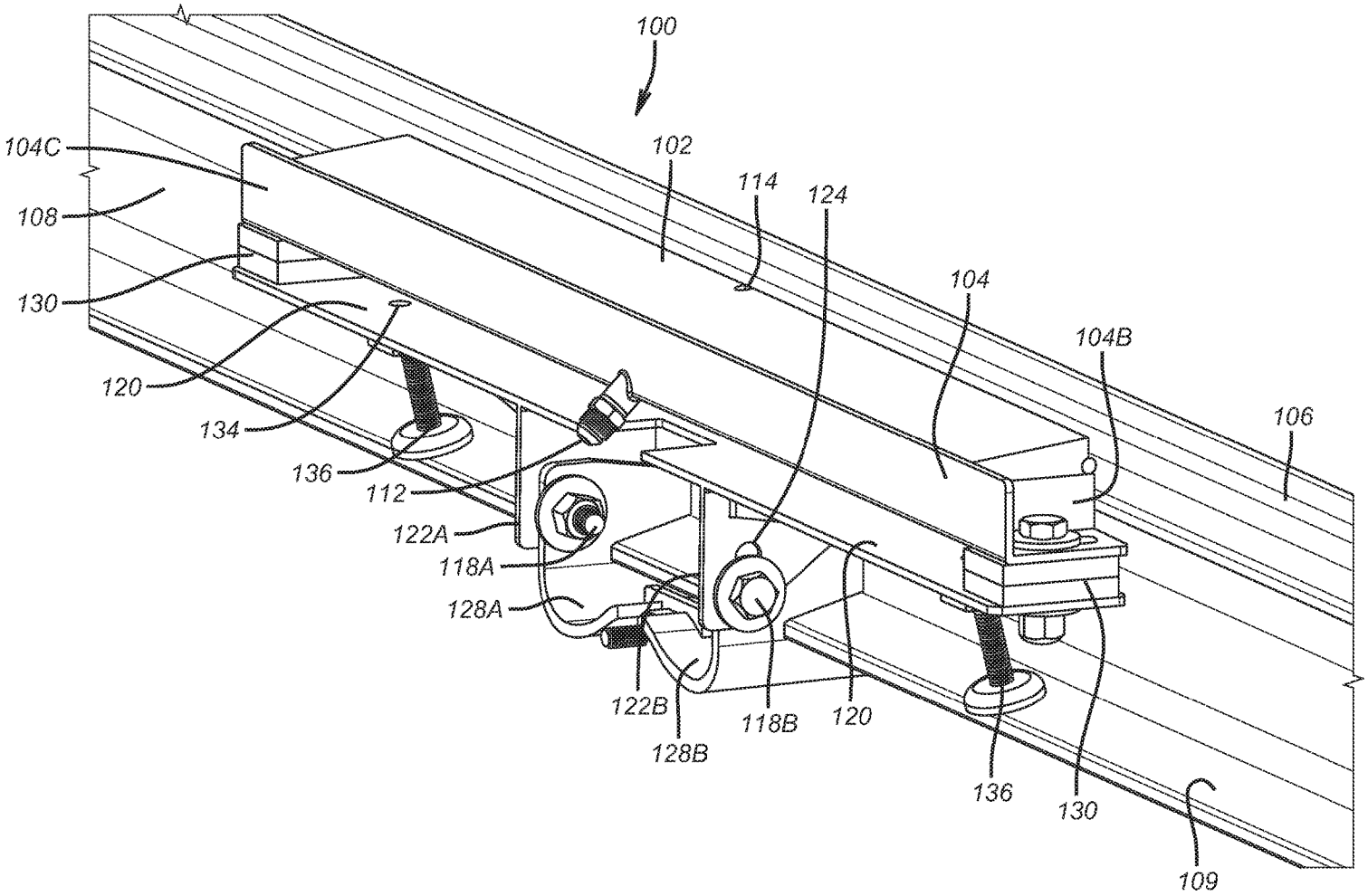
FIG. 3 is a top perspective view of a TOP applicator assembly.
Figure 4:
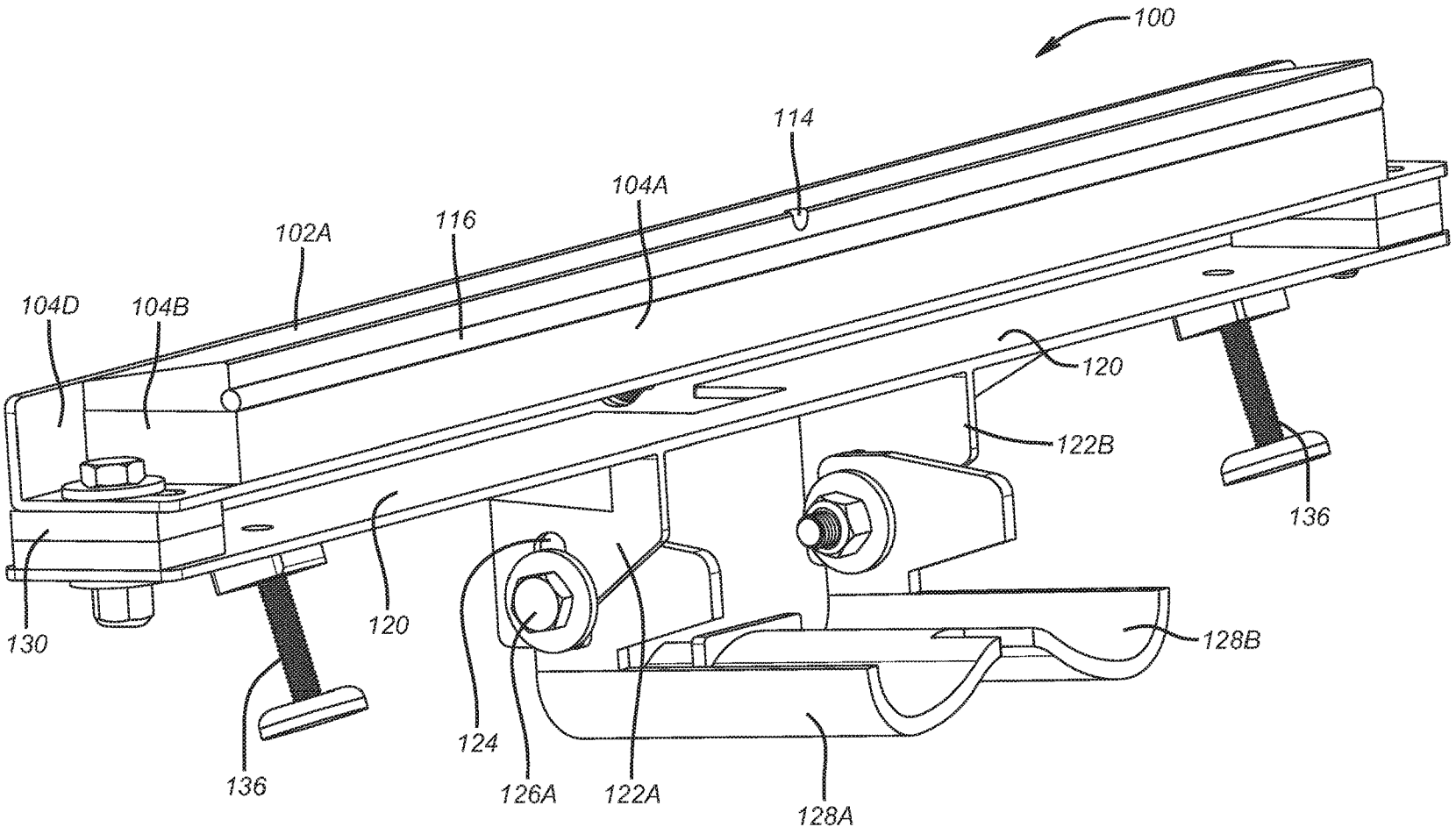
FIG. 4 is a cut-away front view of a TOP applicator assembly.

FIG. 1, a front perspective view, illustrates a TOR applicator assembly affixed to the side of the rail. The TOR applicator assembly contains the TOR applicator. The TOR applicator includes the bar, housing and the optional platform and/or sealant, as described herein. FIG. 2, a side view, illustrates the interaction of the TOR applicator assembly and a train wheel. FIG. 3 is top perspective view of the TOP applicator assembly. FIG. 4 is a cut-away front view of the TOP applicator assembly.

As illustrated, TOR applicator assembly 100 includes a TOR applicator. The TOR applicator contains bar 102. Bar 102 may be seated in bar housing 104. Bar housing 104 may be characterized as having a front wall 104A (which faces, when attached to the rail, the field side of the rail), a side wall 104B, a back wall 104C and a bottom wall 104D. As illustrated in FIG. 1, bar 102 may be seated onto the housing such that the bottom of the bar interfaces with the inside surface of bottom wall 104D. Bar 102 may be releasably attached to and from the inside surface of bottom wall 104D using such conventional fasteners such as snap fit, bolts, screws, nails, adhesives, Velcro, etc.

Since bar 102 sits inside of housing 104 and may be releasably attached, it can easily be replaced. Thus, when bar 102 is damaged, destroyed or otherwise rendered less efficient due to wear and tear, it may be removed and replaced with a fresh bar. Bar 102 may be releasably attached to bar housing 104 with mechanical fasteners or self-tapping screws.

As shown in FIG. 1, in an embodiment, bar housing 104 may not have a top wall such the bar may rest simply in the housing, the upper surface of the bar being exposed to the environment. This arrangement facilitates replacement of a worn or damaged bar with a fresh bar.

In an alternative embodiment, the bar may be integrally formed with the housing.

In some instances, front wall 104A and side wall 104B of bar housing 104 (as illustrated in FIG. 2) may be lower than the upper surface of bar 102 and the back wall 104C of housing 104. When affixed to railhead 108, this arrangement renders it less likely for the wheel 107 of a train to impact and damage the housing and the bar. Strategically placing the bar lower than railhead 108 enables bar housing 104 and bar 102 to withstand impact from the train wheel as from a false flange of a badly worn train wheel.

In a preferred embodiment, shown in FIG. 4, the upper surface 102A of bar 102 is sloped such that, when affixed to railhead 108, the upper surface of the bar slopes away from railhead 108. Such downward sloping is inapposite to TOR applicators of the prior art. In TOR applications of the prior art, the bar, when the TOR applicator is attached to the rail, slopes towards the railhead. In such instances, the TOR applicator is designed to form a reservoir to keep lubricants or friction modifiers on the top of the rail, especially on crown 106 of railhead 108. Such lubricants or friction control compositions are much less viscous than those disclosed herein. Such sloping of the bar towards the railhead makes the bar of the TOR applicator of the prior art more likely to be damaged by train wheels.

In a preferred embodiment, front wall 104A and side wall 104B may be sloped such that the top surface of the front wall and side wall is sloped away from exit orifice 114, typically between 0.5 inches and 1.25 inches below the exit orifice.

Thus, in an embodiment, such as shown in FIG. 1 and FIG. 2, the upper surface of bar 102 slopes away from railhead 108 when TOR applicator assembly 100 is affixed onto railhead 108. The top surface of the bar of the TOR applicator defined herein exhibits a downward slope from exit orifice 114 from railhead 108 to the side of bar 102 closest to the field. When affixed to railhead 108, the configuration of the TOR applicator makes it less likely that TOR applicator will be negatively impacted by the train wheel. When attached to railhead 108, the slope of bar 102 may be from about 5 to about 15 degrees, more preferably from about 8 to about 10 degrees, off the horizontal plane defined by railhead 108.

As illustrated in FIG. 3, friction control composition is pumped through entry port 112 into passageway 110. The composition then exits onto railhead 108 through exit orifice 114 from passageway 110.

FIG. 2 shows threaded screw 113 with entry port 112 at one end. The other end of the threaded screw is secured into platform 120 which, in turn, is fed into bar 102 via front wall 104A of the housing. In an alternative embodiment, the port for receiving the friction control composition may be part of the housing such that the entry port and housing are one unified element.

Figure 5:
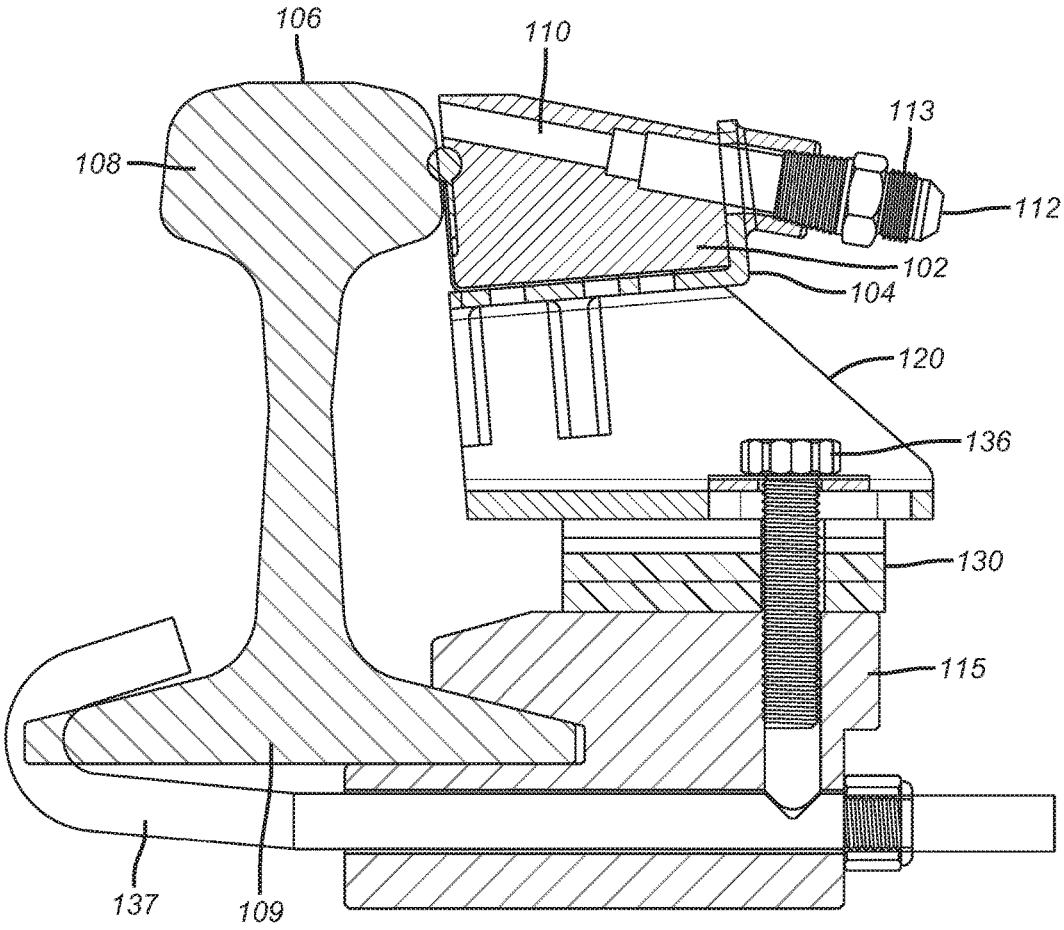
FIG. 5 is a cut-away side view of a TOP applicator demonstrating the passageway for feeding a friction control composition onto the crown of a railhead.

As shown in FIG. 5, passageway 110 provides a path for the flow of the friction control composition from the pump onto railhead 108. The diameter of passageway 110 is preferably between from about 0.50 to about 0.75 inches. When the diameter of passageway 110 is smaller than 0.50 inches, it may be subject to clogging. When the diameter of passageway 110 is larger than 0.75 inches, a larger pump may be required to force the friction control composition through entry port 112 and into the passageway. In certain embodiments, entry port 112 and/or exit orifice 114 may be a mere slit which is opened by pressure from a pump.

A conventional pump, valves and hoses are used for supplying the friction control composition to port 112, through passageway 110 and onto railhead through exit orifice 114.

In FIG. 5, entry port 112 on threaded screw 113 is shown as being connected to passageway 110 within bar 102 that leads to the exit orifice. The pump can be activated in a variety of ways well known in the art including electronic wheel sensors.

In an alternative embodiment, the TOR applicator may not have a housing such that entry port 111 feeds into a unitary element having an exit orifice.

Bar 102 may further include sealant 116, as illustrated in FIG. 4. Sealant 116 assists in the prevention of friction control composition flowing from crown 106 of railhead 108 onto bar 102 of the TOR applicator. Without sealing member 116, the friction control composition, once applied onto railhead 108, may flow onto any surface of the TOR applicator including any side of bar 102 or housing 104. Sealant 116 may thus provide an impermeable membrane between the side of railhead 108 and housing 104. Sealant 116 may be unnecessary in those instance where the friction control composition tends not to flow such as, for instance, when the friction control composition is thixotropic.

In an embodiment, sealing member 116 may be a gasket. Suitable gaskets include Teflon ropes, such as those available commercially from McMaster Carr as product Part #8824K11 Flange Mount PTFE Rope Seal. In addition, sealing member 116 may be composed of an elastomer or a rubber.

At times it may be desirable to move the TOR applicator away from railhead 108 during maintenance such as during rail grinding where the railhead 108 is reverted back to its original profile. Rail grinding requires that objects in the path of the grinder (including the TOR applicator) be moved.

Movement of the TOR applicator away from railhead 108 and towards the field may be accomplished by the use of pivot points 118. As illustrated in FIG. 3, the bottom surface of housing 104 may rest, directly or indirectly, on solid platform 120. Downward brackets 122A and 122B are shown as extending from the bottom of platform 120. Such brackets may be attached to platform 120 or may be integrally formed with the platform. Downward brackets 122A and 122B further have slots 124 for receiving pivot points 135A and 135 B, respectively. The opposite ends of downward brackets 122A and 122B are rail clamps 128A and 128B for securing the rest of the TOR applicator onto railhead 108. Rail clamps 128 and 128B are pivotally coupled to the platform by downward brackets 122A and 122B. Downward brackets 122A and 122B are shown as forming an integral unit with rail clamps 128A and 128B, though they may exist as separate and distinct elements from each other. While pivot points 118A and 118B are illustrated as nuts and bolts, other securement elements may be used. Using pivoting bolts 118A and 118B and slots 124, TOR applicator may be moved up and down. In addition, pivoting bolts 118A and 118B may be used to loosen the attachment between platform 120 and rail clamp 128 such that platform 120 (and the TOR applicator) can be rotated away from railhead 108 in a counter clockwise motion, as can be viewed from FIG. 1.

The surface of platform 120 may further have slots 134 for receiving leveling bolts 136. Leveling bolts 136 in FIG. 5 are shown as being threaded into receiving base 115 which is affixed to rail footer 109 of the rail with J-bolt 137. Leveling bolts 136 may be used to assure that exit orifice 114 from passageway 110 is positioned ⅛th inch or more below railhead 108. In some instances, the bar may be placed higher than ⅛th of an inch below railhead 108 if the bar is composed of tough material and/or if the bar sloping away from the railhead makes the impact by a rail wheel less damaging.

To assure that bar 102 is correctly positioned vis-à-vis railhead 108, leveling bolts 120 on rail foot 20 may be turned and move TOR applicator and thus bar 102 up and down.

TOR applicator may further have one or more shock absorbers 130 to assist in minimizing damage to bar 102. As illustrated in FIG. 1, shock absorbers 130 may be placed between platform 120 and the bottom surface of housing 104. Suitable shock absorbers 130 include a series of washers used with bolts 132 as well as springs and pneumatic absorbers. In a preferred embodiment, bar 102 flexes if stricken by a train wheel. It is important, however, that the bar have the requisite resistance for exit orifice 114 to remain at an optimum elevation vis-à-vis railhead 108. It further is desirable for the bar to be UV resistant and/or water resistant.

In at least one embodiment, bar 102 is elastomeric. In a preferred embodiment, the elastomeric bar exhibits a hardness of between 50 Shore A and 75 Shore A. Elastomeric bar 102 is preferably composed of polyurethane, such as a polyurethane commercially available from H&H Urethane and can molded or shaped by methods well known in the art (e.g. injection molding, machining etc).

In certain embodiments of the disclosure, the parts of applicator 50 that are not intended to flex (i.e. bar 102 and shock absorbers 130 are intended to flex) are made of rigid, strong materials that are intended to last much longer than bar 102. Some examples include certain metals such as 1060 Carbon Steel, and 4130 Molybdenum Steels. These parts can be formed by well-known processes found in the prior art such as machining, stamping and molding.

In at least one embodiment of the disclosure, the friction control composition changes the friction, or coefficient of friction, between the steel surfaces from negative to positive and thereby reduces or eliminates the lateral, longitudinal and/or spin creeps with a corresponding reduction or elimination of lateral forces and wheel-rail wear while increasing stability of the train.

The friction control composition may be placed on crown 106 of railhead 108 through orifice exit 114.

The friction control composition is sufficiently viscous to be pumped to be pushed up to the top of the rail from exit orifice on the applicator bar. In some instance, the friction control composition may have a viscosity of at least 2,000 cP @ 25° C., measured on a Model 35 Fann viscometer having a R1B1 rotor and bob assembly rotating at 300 rpm. The problem with a friction modifier with a viscosity of at least 2,000 cP, is that it may require a larger tubular passage through the applicator bar and also a more powerful pump to push the more viscous friction modifier.

Because exit orifice 110 is intended in some embodiments to be at least ⅛th of an inch below railhead 108, it is important that the friction modifier be thixotropic so that it can be "pushed" up hill onto the top of railhead 10. This assures that a significant amount of the friction modifier ends up on the top surface of the rail and is subsequently carried down the track.

In one embodiment of the disclosure, the friction modifier comprises a thixotropic material that flows easily through an orifice in the applicator bar because of shear thinning. However, as a thixotropic material it then becomes more viscous when it is static on the top or the side of the rail. While the thixotropic friction modifier is being pumped through the pump, hoses and applicator bar, shear thinning lowers the viscosity and allows the friction modifier to flow more easily through the tubular passage and out of the applicator.

In at least one other embodiment, the top of rail applicator of the present disclosure is intended to be used only with friction modifying compositions that are thixotropic and thus able to be pushed upward onto the railhead even though the exit orifice is below the level of the railhead by an amount of at least ⅛th of an inch. The thixotropic nature of the friction modifier assures that when the composition leaves the exit orifice at the top surface of the applicator bar from a position below the top of the rail surface it will "climb" up (i.e. be pushed up) the railhead such that a significant amount of the friction modifier ends up on the top surface of the rail and is subsequently carried down the track.

This lower viscosity during pumping allows for a smaller pump and/or a smaller tubular passage. When the thixotropic friction modifier exits the applicator bar it immediately begins to thicken (i.e. become more viscous). This increased viscosity allows for three desirable effects. First the viscous "glob" of friction modifier is thick enough to be pushed up the side of the railhead and toward the center of the top of the railhead because of the backpressure from the pump. Second, the friction modifier in this more viscous state is less likely to run off the side of the rail onto the ground. Third, as the friction modifier material is "sheared" by the train wheel it becomes less viscous again and is more easily carried down the track to allow more distant spacing of applicators. Such materials enable a more consistent distribution of friction modifier down the rail of the track.

In at least one embodiment, the friction modifier composition has the following composition in weight percent (w/w %):

(a) from about 4 to about 40 w/w % water;
(b) from about 2 to about 20 w/w % rheology additive;
(c) from about 10 to about 40 w/w % water insoluble hydrocarbon;
(d) from about 10 to about 40 w/w % water soluble polyalcohol freezing point depressant;
(e) from about 1 to about 7 w/w % liquid or solid friction modifier; and
(f) from about 1 to about 40 w/w % liquid or solid lubricant.

Optionally, the composition may also contain one or more of:

(g) from 1 to 3 w/w % surfactant or wetting agent
(h) from 0.1 to 0.5 w/w % corrosion inhibitor, and/or
(i) from 0.05 to 0.2 w/w % biocide/fungicide agent.

The water insoluble hydrocarbon may be an isoparaffins, vegetable oil, bio-based triglyceride, a fatty oil or a mixture thereof.

In another embodiment, the friction control composition of the friction control composition comprises:

(a) from 15 to 29 w/w % water
(b) from 4 to 13 w/w % rheology additive
(c) from 11 to 28 w/w % water insoluble hydrocarbon (e.g. isoparaffins, vegetable oils, bio-based triglycerides or fatty oils).
(d) from 22 to 40 w/w % freezing point depressant
(e) from 9 to 24 w/w % liquid or solid friction modifier
(f) from 1 to 6 w/w % liquid or solid lubricant.

As noted above, the composition may also optionally contain one or more of:

(g) from 1 to 3 w/w % surfactant or wetting agent
(h) from 0.1 to 0.5 w/w % corrosion inhibitor, and/or
(i) from 0.05 to 0.2 w/w % biocide/fungicide agent It has been found that adding a water insoluble hydrocarbon to the composition (e.g. an isoparaffin such as SOTROL 220) helps depress the freezing point and also helps stabilize or even improve the rheology of the formulation. This is especially true when the water insoluble hydrocarbon is compared with other freezing point depressants such as glycerin. Other water insoluble hydrocarbons that have environmental advantages over isoparaffins are vegetable oils, bio-based triglycerides and fatty oils such as canola oil. The oils do not have the same freezing point advantages as isoparaffins but they are environmentally friendly.

The addition of the water insoluble hydrocarbon (either isoparaffins or oils) in the partially water based friction control composition is counterintuitive because one would have guessed that it would not mix well with the water and would in all likelihood separate. However, we believe that the clay has receptor sites that allow the water insoluble hydrocarbon to bind onto the clay and keep the final product homogenous. The result is a composition that may contain lower amounts of water and in the case of isoparaffins lower amounts of soluble polyalcohol freezing point depressants such as glycerine. As pointed out above, water based friction control compositions have problem with maintenance and typical freezing point depressants can cause negative rheology effects on the composition.

An example of a thixotropic friction modifier material usable in the current is "TOR Armor" from Whitmores of Rock Wall, Tex. Thixotropic materials allow for pumps, hoses and applicators with optimum sizes. In at least one embodiment, the replaceable applicator bar is made of a polyurethane insert. This assures that the bar flexes if it is hit by a train wheel to help prevent damage. However, the bar is also tough enough to keep its rough profile even after such an impact.

The invention claimed is:

1. An applicator for delivering a friction control composition to a railhead, the applicator comprising:

(a) a housing;
(b) a bar positioned in the housing;
(c) a friction control composition exit orifice on the upper surface of the bar wherein, when the applicator is affixed to the railhead, the upper surface of the bar has a downward slope from the railhead.

2. The applicator of claim 1, wherein the slope is from about 5 to about 15 degrees off the horizontal plane defined by the railhead.

3. The applicator of claim 2, wherein the slope is from about 8 to about 10 degrees off the horizontal plane defined by the railhead.

4. The applicator of claim 1, further comprising a platform onto which the bottom of the housing rests.

5. The applicator of claim 1, further comprising a friction control composition entry port located on the lower portion of the slope.

6. The applicator of claim 5, further comprising a passageway from the friction control composition entry port to the friction control composition exit orifice for transporting the friction control composition.

7. An applicator for delivering a friction control composition to a railhead, the applicator comprising:

(a) a housing;
(b) an elastomeric bar positioned in the housing;
(c) a friction control composition exit orifice on the upper surface of the elastomeric bar, wherein the upper surface of the elastomeric bar, when the applicator is affixed to the railhead, slopes downward away from the railhead;
(d) a friction control composition entry port on the lower portion of the slope; and
(e) a passageway from the friction control composition entry port to the friction control composition exit orifice.

8. The applicator of claim 7, wherein the elastomer of the elastomeric bar is a polyurethane.

9. The applicator of claim 8, wherein the polyurethane has a hardness of between 50 Shore A and 75 Shore A.

10. The applicator of claim 7, wherein the housing has a side wall, a front wall and a back wall and further comprising a sealant adjacent to the front wall.

11. The applicator of claim 7, further comprising a platform onto which the bottom of the housing rests.

12. The applicator of claim 7, wherein the passageway is tubular and has a diameter between from about 0.5 to about 0.75 inches.

13. An applicator assembly comprising the applicator of claim 7 and a clamp for coupling the platform onto the railhead.

14. A method of delivering a friction control composition onto the crown of a railhead using the applicator of claim 7, the method comprising:

(a) pumping the friction control composition into the passageway and through the exit orifice; and (b) applying onto the crown of the railhead the friction control composition from the exit orifice.

15. The method of claim 14, wherein the slope of the bar from the top surface of the railhead is between from about 5 to about 15 degrees.

16. The method of claim 14, wherein the friction control composition is thixotropic.

17. The method of claim 16, wherein the thixotropic friction control composition comprises (a) from about 4 to about 40 wt. % water;

(b) from about 2 to about 20 wt. % rheology additive;

(c) from about 10 to about 40 wt. % water insoluble component selected from the group consisting of hydrocarbons, vegetable oils, bio-based triglycerides and fatty oils;

(d) from about 10 to about 40 wt. % water soluble polyalcohol freezing point depressant;

(e) from about 9 to about 24 wt. % liquid or solid friction modifier; and (f) from about 1 to about 40 wt. % liquid or solid lubricant.

18. A method of delivering a friction control composition onto the crown of a railhead using the applicator of claim 1, the method comprising pumping the friction control composition through the exit orifice onto the crown of the railhead.

19. The method of claim 18, wherein the viscosity of the friction control composition is at least 2,000 cP.

20. The method of claim 18, wherein the friction control composition is thixotropic.

21. The method of claim 20, wherein the thixotropic friction control composition comprises (a) from about 4 to about 40 wt. % water;

(b) from about 2 to about 20 wt. % rheology additive;

(c) from about 10 to about 40 wt. % water insoluble component selected from the group consisting of hydrocarbons, vegetable oils, bio-based triglycerides and fatty oils;

(d) from about 10 to about 40 wt. % water soluble polyalcohol freezing point depressant;

(e) from about 9 to about 24 wt. % liquid or solid friction modifier; and (f) from about 1 to about 40 wt. % liquid or solid lubricant.

22. The method of claim 21, wherein the thixotropic friction control composition further comprises:

(g) from 1 to 3 wt. % surfactant or wetting agent (h) from 0.1 to 0.5 wt. % corrosion inhibitor, and/or (i) from 0.05 to 0.2 wt. % biocide/fungicide agent.

23. The method of claim 21, wherein the thixotropic friction control composition comprises:

(a) from 15 to 29 wt. % water (b) from 4 to 13 wt. % rheology additive (c) from 11 to 28 wt. % water insoluble component selected from the group consisting of hydrocarbons, vegetable oils, bio-based triglycerides and fatty oils;

(d) from 22 to 40 wt. % freezing point depressant (e) from 9 to 24 wt. % liquid or solid friction modifier (f) from 1 to 6 wt. % liquid or solid lubricant.

* * * * *